US011064793B2

(12) United States Patent
Beck

(10) Patent No.: US 11,064,793 B2
(45) Date of Patent: Jul. 20, 2021

(54) UNIVERSAL ADAPTER SYSTEM FOR A DYNAMIC LOAD CARRIAGE APPARATUS

(71) Applicant: TYR Tactical, LLC, Peoria, AZ (US)

(72) Inventor: Jason Beck, Peoria, AZ (US)

(73) Assignee: TYR Tactical, LLC, Peoria, AZ (US)

( * ) Notice: Subject to any disclaimer, the term of this patent is extended or adjusted under 35 U.S.C. 154(b) by 0 days.

(21) Appl. No.: 16/799,261

(22) Filed: Feb. 24, 2020

(65) Prior Publication Data

US 2020/0205555 A1 Jul. 2, 2020

Related U.S. Application Data

(63) Continuation of application No. 16/038,036, filed on Jul. 17, 2018, now Pat. No. 10,568,407, which is a continuation of application No. 14/708,398, filed on May 11, 2015, now Pat. No. 10,028,570.

(60) Provisional application No. 61/992,116, filed on May 12, 2014.

(51) Int. Cl.

| | |
|---|---|
| ***A45F 3/04*** | (2006.01) |
| ***A45F 3/14*** | (2006.01) |
| ***A45F 3/06*** | (2006.01) |
| ***A41D 13/05*** | (2006.01) |
| ***A41F 17/00*** | (2006.01) |
| ***A44B 13/00*** | (2006.01) |
| ***A44B 13/02*** | (2006.01) |
| *A45F 3/00* | (2006.01) |

(52) U.S. Cl.

CPC ..... *A45F 3/04* (2013.01); *A41D 13/0518* (2013.01); *A41F 17/00* (2013.01); *A44B 13/0029* (2013.01); *A44B 13/02* (2013.01); *A45F 3/06* (2013.01); *A45F 3/14* (2013.01); *A45F 2003/001* (2013.01); *A45F 2003/045* (2013.01); *Y10T 24/45681* (2015.01); *Y10T 24/45696* (2015.01); *Y10T 29/49828* (2015.01); *Y10T 29/49829* (2015.01)

(58) Field of Classification Search

CPC ..... A44B 13/02; A44B 13/0029; A41F 17/00; A41F 3/04; A41F 3/06; A41F 3/14; A41D 13/0518; A45F 2003/045; A45F 2003/001; Y10T 24/4596; Y10T 24/45681

See application file for complete search history.

(56) References Cited

U.S. PATENT DOCUMENTS 5,806,741 A * 9/1998 Kirk ..... A45F 5/00 224/634

6,079,602 A * 6/2000 Howell ..... A45F 3/047 224/262

(Continued)

*Primary Examiner* — Robert Sandy
*Assistant Examiner* — Rowland Do
(74) *Attorney, Agent, or Firm* — KW Law, LLP

(57) ABSTRACT

Embodiments of universal adapter system including a receiver component having base portion configured to be coupled to a base belt worn by an individual and a locking mechanism which is operative to be engaged to a mounting bar of an adapter component that is secured to a dynamic load carriage apparatus, wherein the mounting bar is capable of a sliding action that compensates for a shift in load that is associated with the individual are disclosed. In operation, the receiver component may be engaged and disengaged from the adapter component while being worn by the individual using a single-handed operation.

10 Claims, 8 Drawing Sheets

(56) References Cited

U.S. PATENT DOCUMENTS

| | | | | |
|---|---|---|---|---|
| 6,301,757 | B1 * | 10/2001 | Kunii | A44B 11/253 24/616 |
| 6,321,959 | B1 * | 11/2001 | Howell | A45F 3/047 224/262 |
| 7,337,935 | B1 * | 3/2008 | Glanville | A45F 3/04 224/262 |
| 2015/0320182 | A1 * | 11/2015 | Beck | A44B 13/0029 24/644 |

* cited by examiner

UNIVERSAL ADAPTER SYSTEM FOR A DYNAMIC LOAD CARRIAGE APPARATUS

CROSS-REFERENCE TO RELATED APPLICATIONS

This application is a continuation of U.S. Ser. No. 16/038,036, filed on Jul. 17, 2019, and issued as U.S. Pat. No. 10,568,407 which is a continuation of U.S. Ser. No. 14/708,398, filed on May 11, 2015, and issued as U.S. Pat. No. 10,028,570 which claims priority to and the benefit of U.S. provisional application Ser. No. 61/992,116 filed on May 12, 2014, each of which is herein incorporated by reference in its entirety for any purpose.

FIELD

The present document relates generally to systems and methods for a universal adapter having modular components that operatively couple a base belt to a dynamic load carriage apparatus attached to a protective vest, and in particular to a universal adapter system having an adapter component that is coupled to a receiver component and is capable of a compensating action whenever a shift in load occurs by an individual wearing the protective vest.

BACKGROUND

Many different types of tactical belts are worn by military personnel to provide a platform that allows various types of accessories, such as holsters and weapons, to be easily attached or detached for use by the individual. In some embodiments, the tactical base belt worn by an individual may be designed to be coupled to a protective vest and/or a load-bearing pack, for example a backpack, such that the individual may comfortably wear the protective vest and/or carry the backpack over long distances and over hostile terrain.

There are many manufacturers that design and manufacture various types of backpacks, protective vests and other load-bearing packs or tactical wear designed for different types of tactical missions or purposes. As such, one type of backpack or protective vest from one manufacturer may be needed for a particular phase of a mission, while another type of backpack or protective vest from another manufacturer is required for a different phase of the mission. Unfortunately, the multitude of different tactical base belts in combination with the different types of backpacks and other load-bearing packs or tactical wear available in the market may make it difficult to find one kind of backpack or protective vest that is compatible for engagement and mounting with a particular type of tactical base belt since different types of backpacks and/or protective vests from one or more manufacturers may not have an adapter arrangement that is compatible for mounting with a particular type of tactical base belt from a different manufacturer.

In addition, the individual may wear a dynamic load carriage apparatus coupled to a protective vest worn by the individual that assists in compensating for the shift in weight that occurs when an individual assumes different types of body positions. Some embodiments of a dynamic load carriage system may include first and second stays which are oriented parallel to one another and are coupled to a protective vest; however, there does not exist a universal adapter system for universally coupling the stays of the dynamic load carrier apparatus to a tactical belt worn by an individual.

BRIEF DESCRIPTION OF THE DRAWINGS

Corresponding reference characters indicate corresponding respective elements among the views of the drawings. The headings used in the figures should not be interpreted to limit the scope of the claims.

DESCRIPTION

As described herein, embodiments of a universal adapter system provide a mechanical mounting arrangement for securing various types of load-bearing packs or tactical wear to a base belt, such as a tactical belt. In general, the universal adapter system allows different types of load-bearing packs or tactical wear to be mounted to the same base belt regardless of the fact that each of the load-bearing packs and/or tactical wear may be from different manufacturers and incompatible for mounting with a particular base belt from another manufacturer. In one aspect, the universal adapter system includes an adapter component secured to a dynamic load carriage apparatus that is coupled to a load carrier or tactical wear in which the adapter component is specifically configured to engage a corresponding receiver component secured to the base belt for allowing various types of protective vests having a dynamic load carriage apparatus to be mounted directly to the same type of base belt. In addition, the adapter component is configured to be mechanically coupled to the receiver component to allow a sliding and/or twisting action between the receiver component and the adapter component when compensating for any shift in load that occurs.

Figure 1:
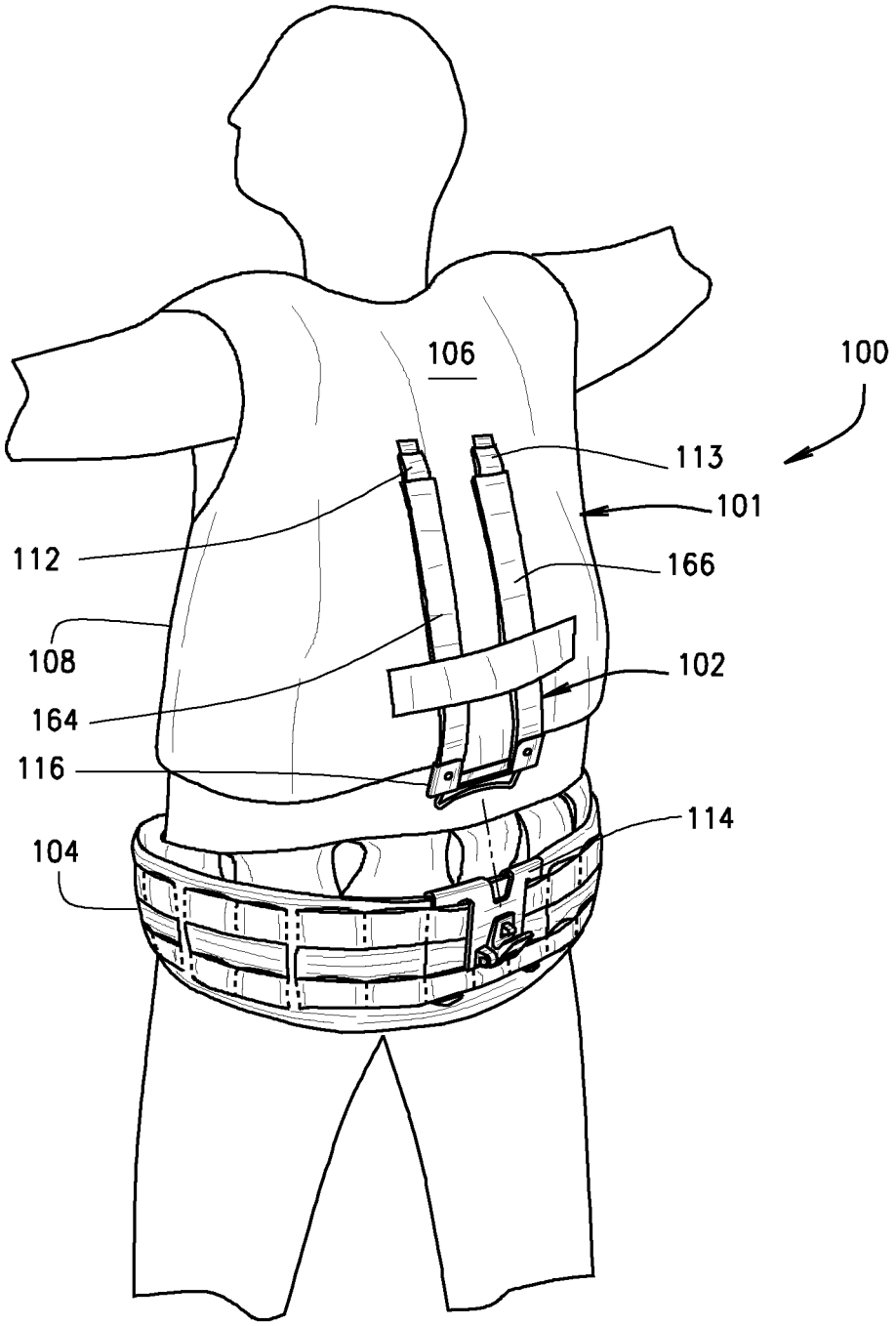
FIG. 1 is a perspective view of one embodiment of the universal adapter system having a receiver component adapted for engagement with an adapter component for mounting a protective vest with a dynamic load carriage apparatus to a base belt worn by an individual.

Referring to the drawings, embodiments of a universal adapter system are illustrated and generally indicated as 100, in FIGS. 1-22. Referring to FIG. 1, one embodiment of a universal adapter system 100 includes a receiver component 114 secured to a base belt 104 worn around the waist of an individual and an adapter component 116 coupled to a dynamic load carriage apparatus 102 secured to a load carrier, such as a protective vest 101, in order to mount the protective vest 101 to the base belt 104. In operation, the receiver component 114 is secured to the base belt 104 and is operable to be mechanically coupled to the adapter component 116 such that a sliding and/or twisting action occurs by the adapter component 116 relative to the receiver component 114 whenever a shift in load occurs.

In some embodiments, the protective vest 101 may include a rear carrier 106 and a front carrier 108 that are each configured to receive a ballistic plate (not shown) therein for providing protection against ballistic projectiles. In some embodiments, the protective vest 101 may also include KEVLAR® alone or in combination with other fabrics having a high ballistic performance.

Figure 19:
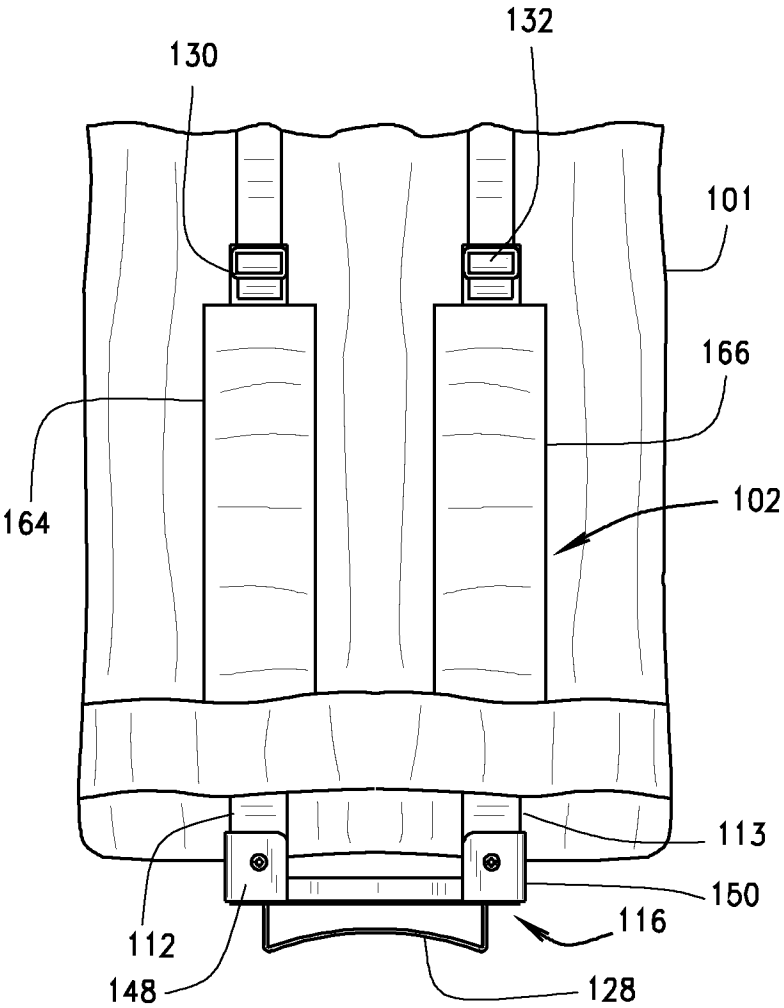
FIG. 19 is a front view of the protective vest showing the first and second stays of the dynamic load carriage apparatus engaged to the adapter component of the universal adapter system.
Figure 18:
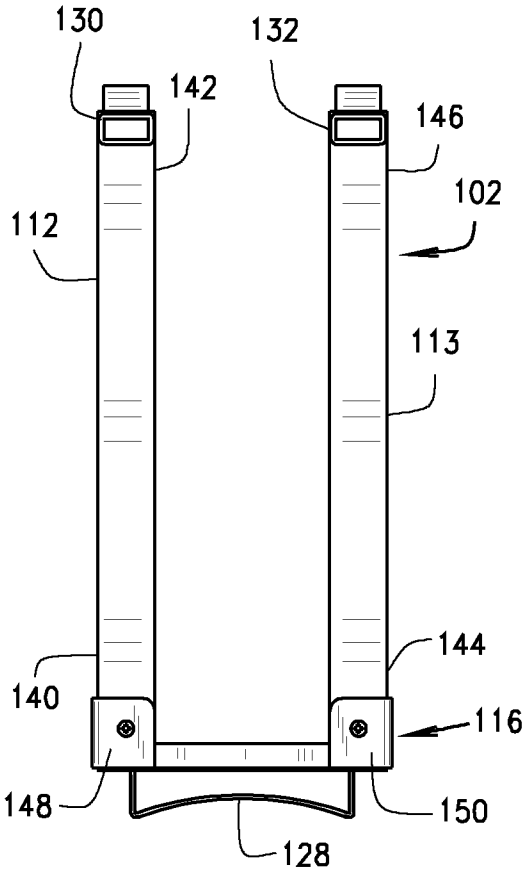
FIG. 18 front view showing first and second stays of the dynamic load carriage apparatus engaged to the adapter component of the universal adapter system.

The dynamic load carriage apparatus 102 is operable to compensate for any shift in load that occurs as described above. In some embodiments, the dynamic load carriage apparatus 102 includes a first stay 112 and a second stay 113 which are arranged in a parallel orientation relative to each other for supporting and compensating for the shifting weight of the protective vest 101 and/or load bearing pack when the individual assumes different body positions. In one aspect, the first stay 112 and/or the second stay 113 may move in a sliding action, bending action, rotating action and/or twisting action to compensate for the shifting load of the load carrier. As a result of the compensating action of the first and second stays 112 and 113, the dynamic load carriage apparatus 102 directs the weight of the load carrier substantially along the base belt 104 and hips of the individual regardless of the body position or movement undertaken by the individual. In some embodiments, the first stay 112 may define a first end portion 140 and a second end portion 142, while the second stay 113 may also define a first end portion 144 and a second end portion 146. As shown in FIGS. 18 and 19, the second end portions 142 and 146 of the first and second stays 112 and 113 may be coupled to a first attachment member 130 and a second attachment member 132, respectively, for attaching the dynamic load carriage apparatus 102 to the protective vest 101. As further shown, the first end portions 140 and 144 of the first and second stays 112 and 113 may be secured to the adapter component 116 as shall be discussed in greater detail below. In some embodiments, a first sleeve 164 may encase at least a portion of the first stay 112 and a second sleeve 166 may encase at least a portion of the second stay 113.

Figure 2:
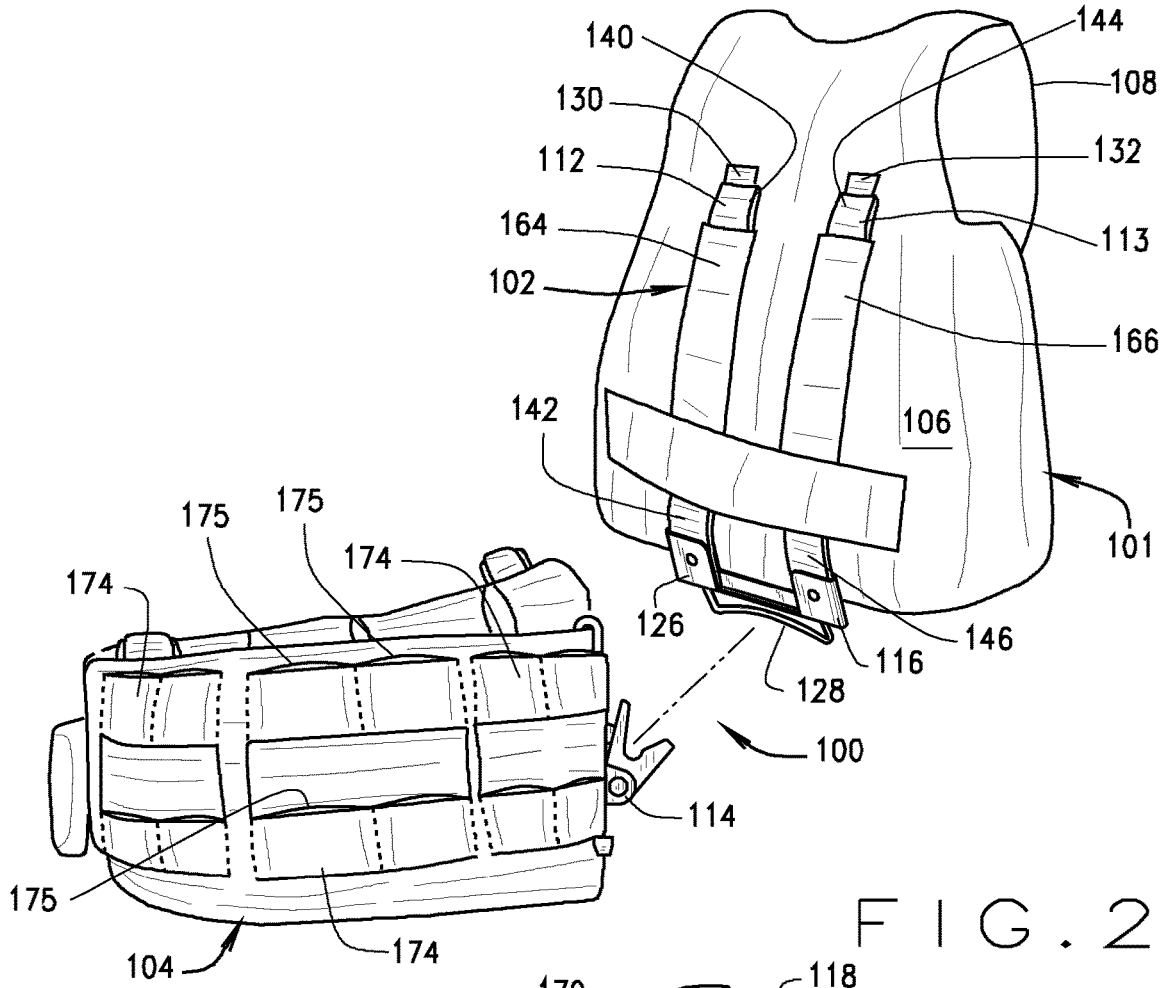
FIG. 2 is a perspective view of the universal adapter system showing the receiver component that is attached to the base belt prior to engagement with the adapter component that is attached to the dynamic load carriage apparatus when mounting the protective vest to the base belt.
Figure 3:
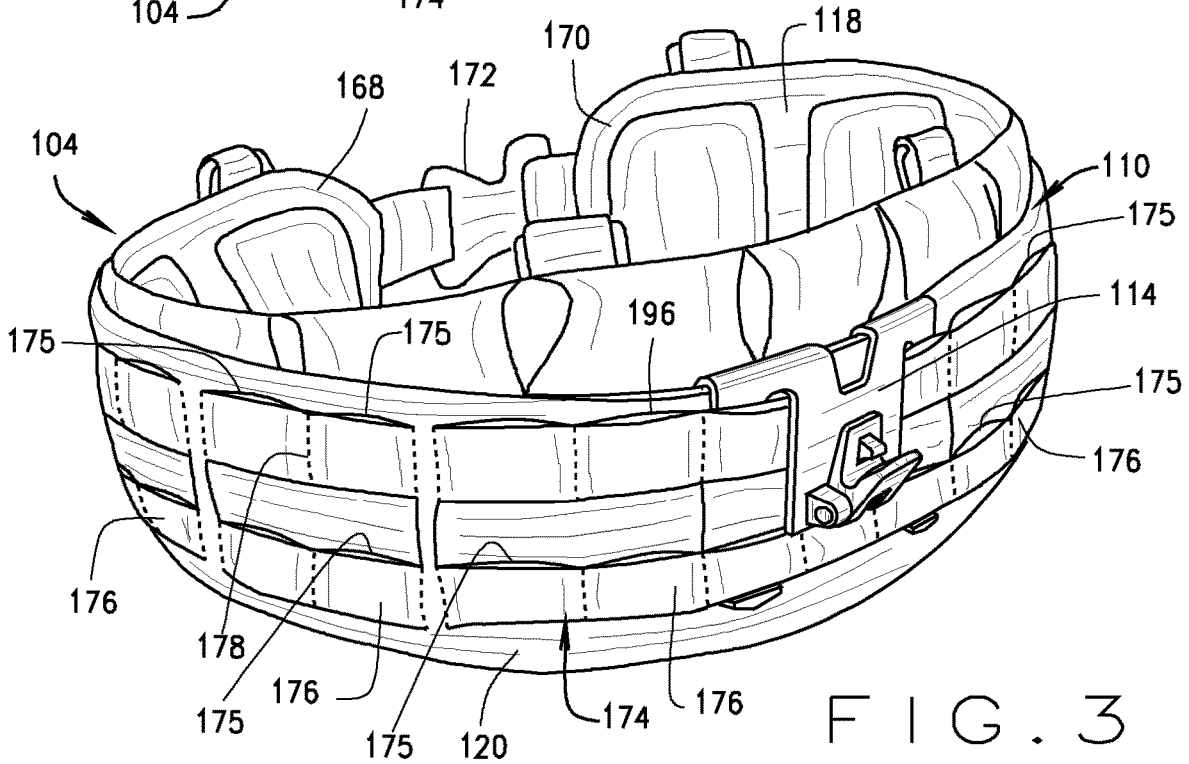
FIG. 3 is a perspective view of the receiver component coupled to the base belt.

Referring to FIGS. 2 and 3, in one arrangement of the universal adapter system 100 the receiver component 114 may be secured to the base belt 104 and configured to be mechanically engaged and disengaged from the adapter component 116. In some embodiments, the adapter component 116 may be secured to a load carriage apparatus 102, which is mounted to a protective vest 101 such that disengagement of the adapter component 116 from the receiver component 114 allows the base belt 104 to be decoupled from the protective vest 101. The base belt 104 may include an elongated belt body 110 defining an interior surface 118 and an exterior surface 120 forming a first end 168 and a second end 170 that are secured together with a conventional buckle 172 as shown in FIG. 3. In some embodiments, the base belt 104 may be a tactical-type belt configured to be worn around the waist of an individual and adapted to support the weight of a load carrier, although other types of belts are contemplated.

In some embodiments, the belt body 110 may include one or more webbing sections 174 secured to the exterior surface 120 of the belt body 110 with each webbing section 174 having one or more horizontal bands 176 sewn or otherwise attached to the exterior surface 120 of the belt body 110 through stitching lines 178. In addition, each horizontal band 176 may extend in substantial parallel orientation relative to the longitudinal axis of the belt body 110 with each horizontal band 176 defining one or more vertically-oriented channels 175 formed between a respective horizontal band 176 and the exterior surface 120 of the belt body 110. In some embodiments, the horizontal bands 176 may be formed integral with the material of the belt body 110.

Figure 8:
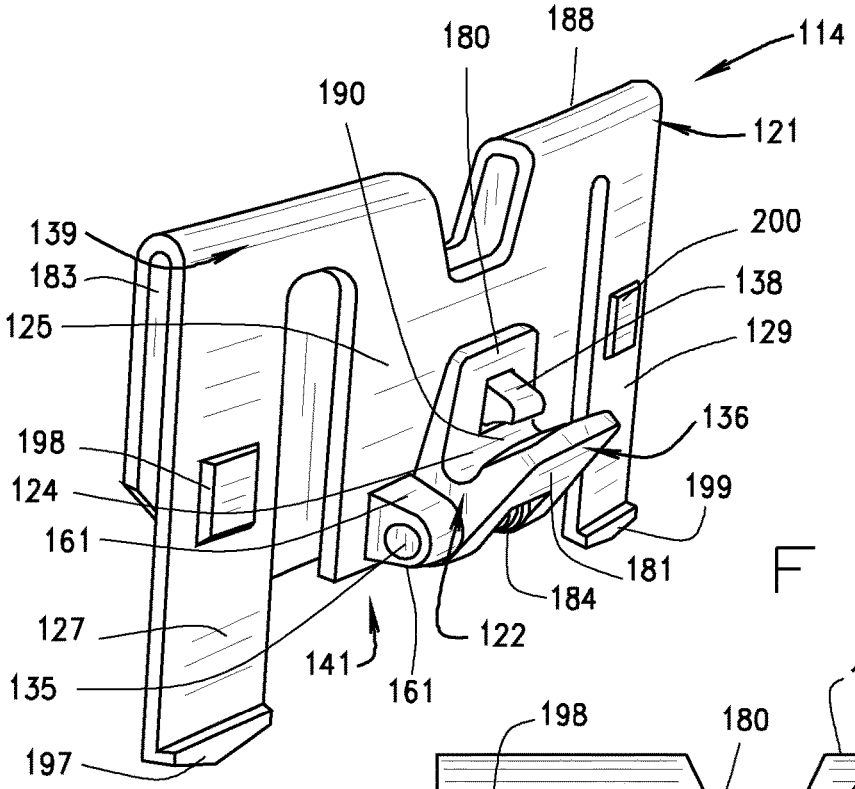
FIG. 8 is a perspective view of the receiver component.
Figure 9:
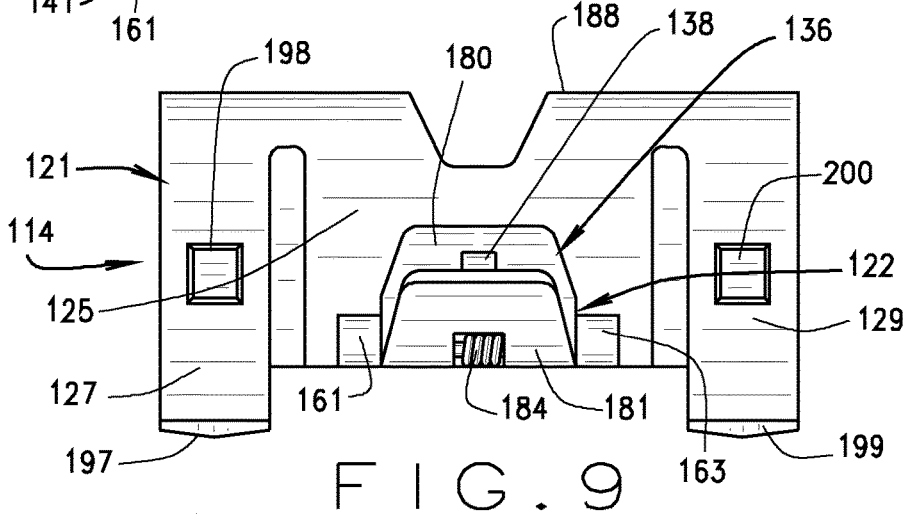
FIG. 9 is a front view of the receiver component.
Figure 10:
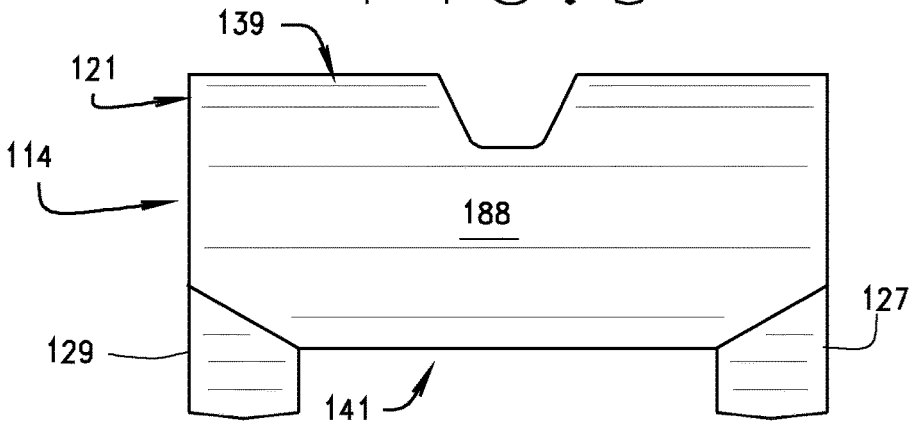
FIG. 10 is a rear view of the receiver component.
Figure 11:
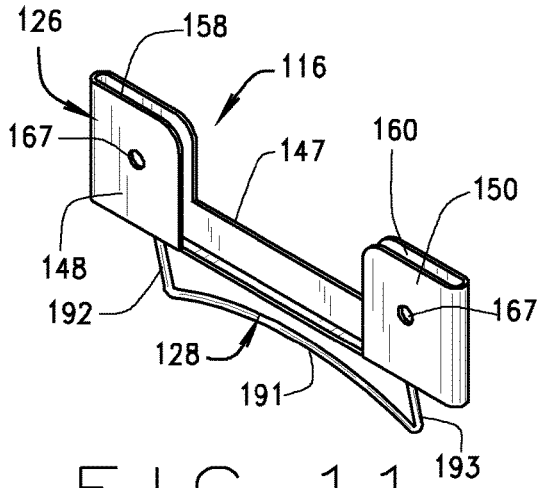
FIG. 11 is a perspective view of the adapter component.

Referring to FIGS. 8-10, in some embodiments, the receiver component 114 may include a base portion 121 having a locking mechanism 122 for mechanically engaging and disengaging the receiver component 114 relative to the adapter component 116. As shown in FIGS. 8 and 9, the locking mechanism 122 includes a retention arm 138 that cooperates with a rotatable biased arm 136. The retention arm 138 and the rotatable biased arm 136 are operable to mechanically engage and disengage the adapter component 116 relative to the receiver component 114. In particular, the rotatable biased arm 136 is operative to rotate between an open position (FIG. 6) in which the adapter component 116 may be allowed to engage or disengage relative to the receiver component 114 and a closed position (FIG. 7) in which the adapter component 116 is secured to the receiver component 116. In some embodiments, the engagement and disengagement of the universal adapter system 100 is a "click-in" and "click-out" operation to engage and disengage the adapter component 116 from the receiver component 114 in either a hands-free or one handed operation by the individual wearing the protective vest 101 and the base belt 104 as shall be discussed in greater detail below.

Figure 5:
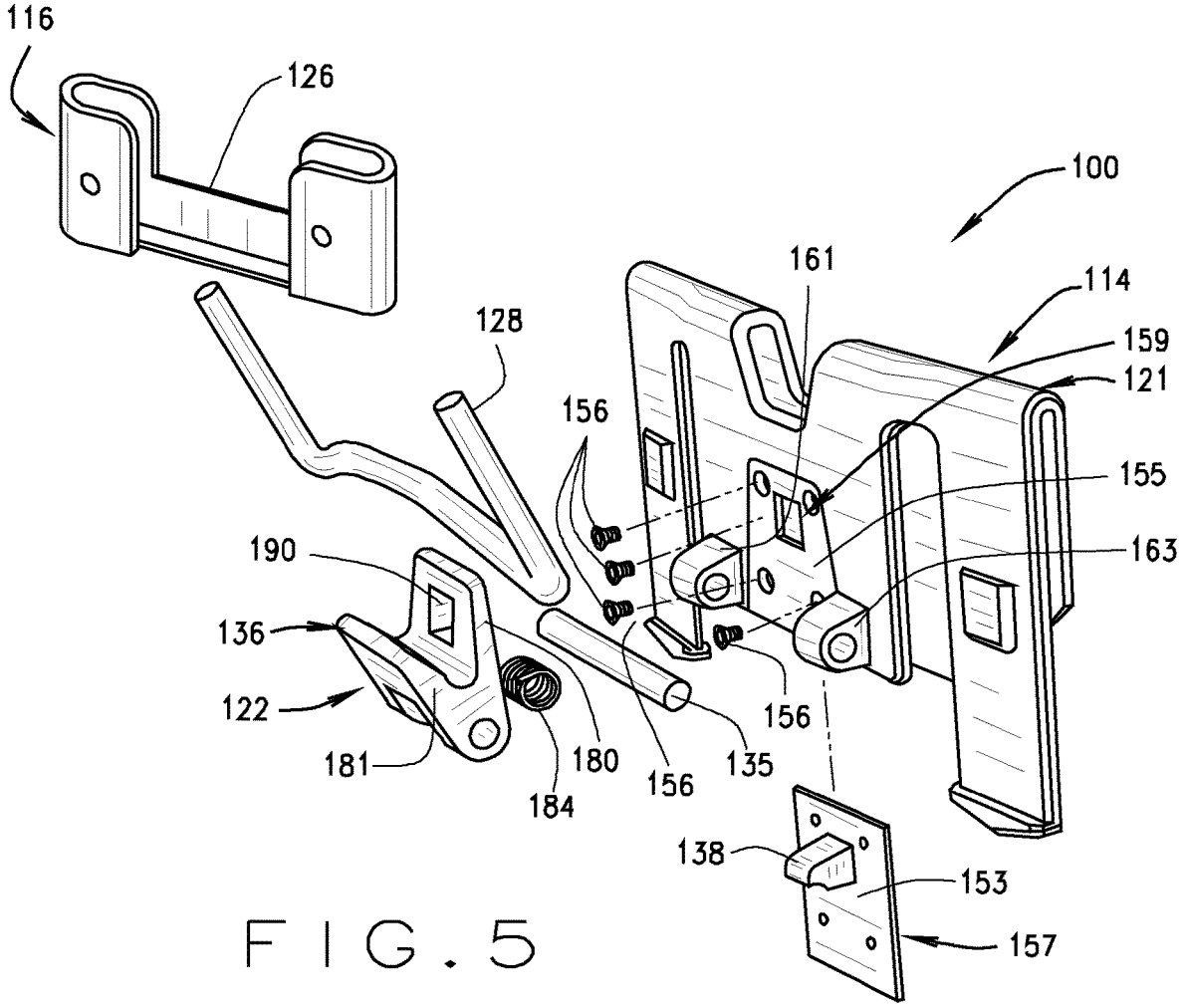
FIG. 5 is an exploded view of the universal adapter system of FIG. 1.
Figure 6:
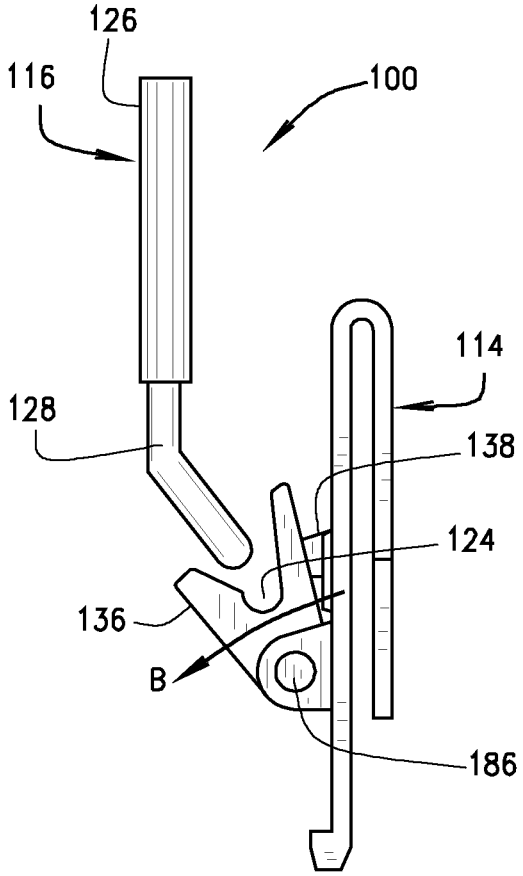
FIG. 6 is a side view of the receiver component prior to engagement with the adapter component of the universal adapter system of FIG. 1.
Figure 7:
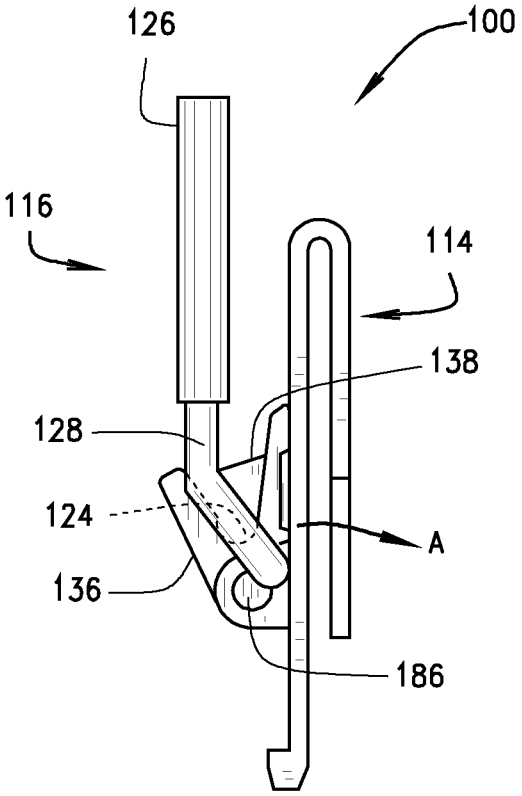
FIG. 7 is a side view of the receiver component engaged with the adapter component of the universal adapter system of FIG. 1.

As shown, the base portion 121 defines a middle arm 125 having a first side arm 127 defined on one side of the middle arm 125 and a second side arm 129 defined on an opposite side of the middle arm 125 that collectively form an upper portion 139 and a lower portion 141 of the receiver component 114. In some embodiments, the lower portion 141 of the middle arm 125 includes a first mounting member 161 and an opposite second mounting member 163 that each define a respective channel configured to receive respective ends of a rotating bar 135 (FIG. 8), which allows the rotatable biased arm 136 to rotate about the rotating bar 135 at pivot point 186 (FIGS. 6 and 7) such that the rotatable biased arm 136. As shown in FIGS. 5 and 8, a recess 155 is formed between the first mounting member 161 and the second mounting member 163 of the middle arm 125 and defines a first plurality of openings 159 that are arranged to be aligned with a second plurality of openings 157 formed along a plate 153 secured behind the middle portion 125 of the base portion 121 for receiving securing members 156 that secure the plate 153 to the recess 155. In this arrangement, the retention arm 138 extends outwardly from the plate 153 and through the base portion 121 in a fixed position relative to the rotatable biased arm 136.

As shown in FIGS. 8 and 9, in some embodiments the first side arm 127 may define a lower retention portion 197 and an upper retention portion 198, while the second side arm 129 also defines a lower retention portion 199 and an upper retention portion 200, which are each configured to engage respective channels 175 defined along one or more of webbing portions 174 of the base belt 104 to secure the receiver component 114 to the base belt 104. In some embodiments, the base portion 121 of the receiver component 114 may define any combination of lower and upper retention portions 197-200 to secure the receiver component 114 to the base belt 104. In some embodiments, the receiver component 114 may include a retainer portion 188 that defines an arm forming a slot 183 (FIG. 8) to couple the receiver component 114 to the upper edge 196 of the base belt 104 as shown in FIG. 3.

Figure 4:
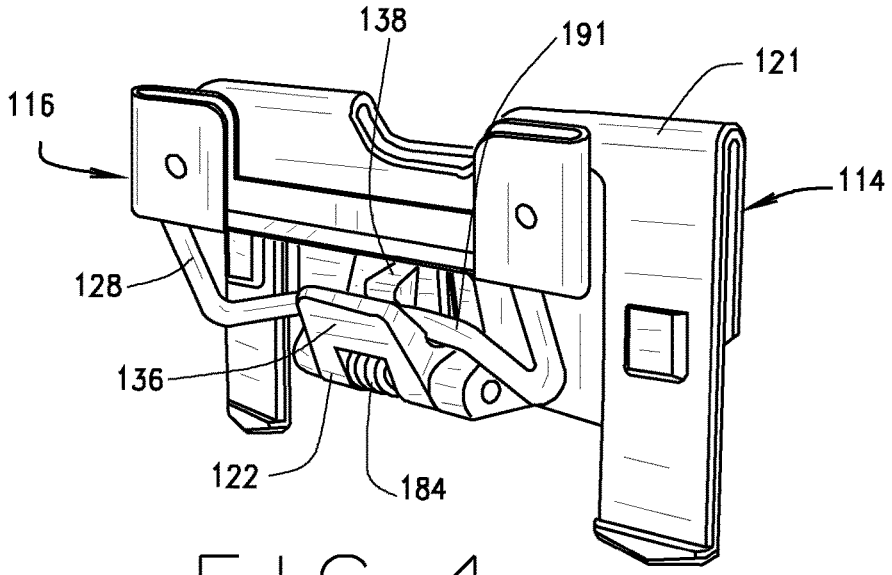
FIG. 4 is an assembled perspective view of the receiver component engaged to the adapter component of the universal adapter system of FIG. 1.

As further shown, the rotatable biased arm 136 forms a first raised portion 180 and a second raised portion 182 that collectively form a channel 124 configured to receive a mounting bar 128 of the adapter component 116 therein when securing the receiver component 114 to the adapter component 116 as shown in FIGS. 4 and 8. As illustrated in FIG. 8, a passage 190 is formed through first raised portion 180 and communicates with and is in perpendicular orientation relative to the channel 124 defined by the rotatable biased arm 136. The passage 190 is configured to permit the retention arm 138 to extend outwardly through the first raised portion 180 to block access to the channel 124, thereby preventing the mounting bar 128 from disengaging from the channel 124 of the rotatable biased arm 136 when the locking mechanism 122 is in the closed position.

As further shown in FIGS. 4, 5, 8, and 9, the receiver component 114 includes a spring 184 that applies a bias to the rotatable biased arm 122 in direction A (FIG. 7) to bias the rotatable biased arm 136 to a normally-closed position such that the retention arm 138 extends outwardly through the passage 190 to block access with the channel 124 of the rotatable biased arm 136. When the adapter component 116 is engaged to the receiver component 114 and the receiver component 114 is in the closed position the mounting bar 128 of the adapter component 116 is prevented from disengagement from the rotatable biased arm 136 of the retention arm 138.

Figure 12:
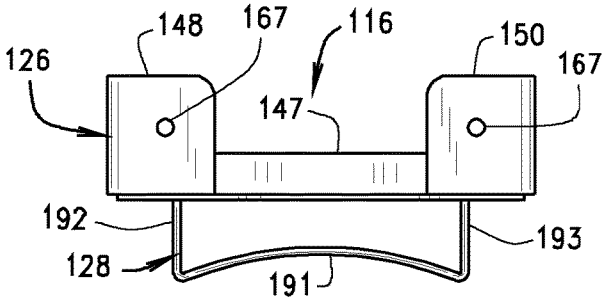
FIG. 12 is a rear view of the adapter component.
Figure 13:
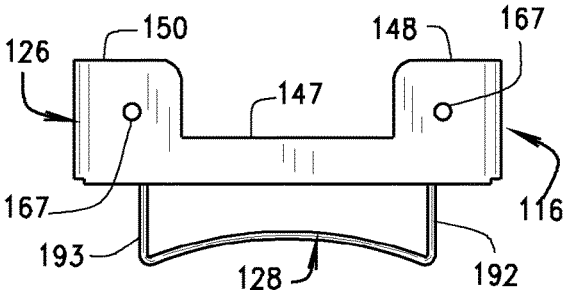
FIG. 13 is a front view of the adapter component.
Figure 14:
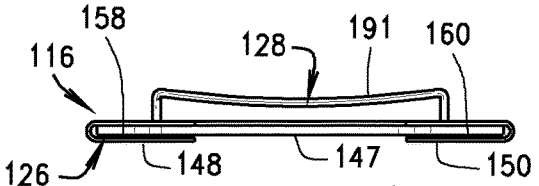
FIG. 14 is a top view of the adapter component.
Figure 15:
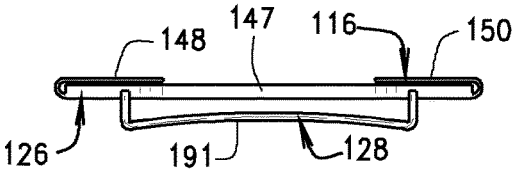
FIG. 15 is a bottom view of the adapter component.
Figure 17:
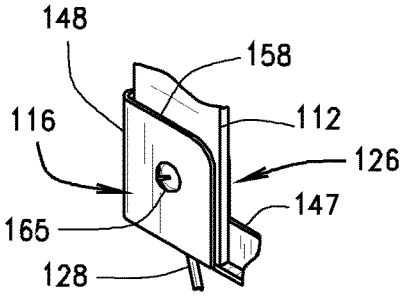
FIG. 17 is an enlarged view showing the stay of the dynamic load carriage apparatus engaged to the adapter component of the universal adapter system.
Figure 16:
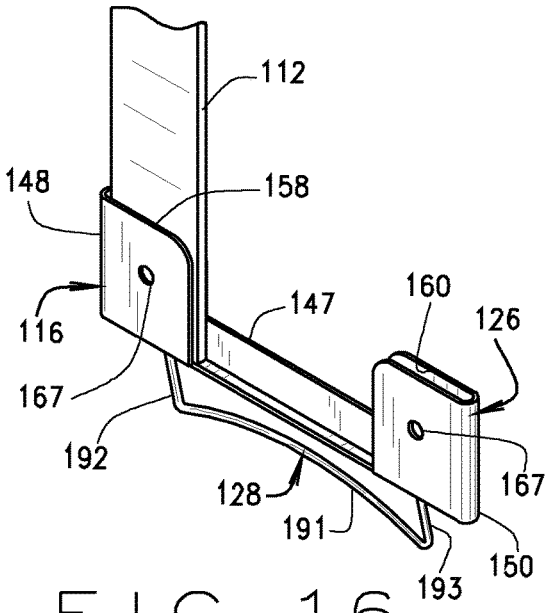
FIG. 16 is an illustration showing one of the stays of the dynamic load carriage apparatus engaged to the adapter component of the universal adapter system.

Referring to FIGS. 12-17, in some embodiments the adapter component 116 may include a mounting body 126 configured to be mounted to the first and second stays 112 and 113 of the dynamic load carriage apparatus 102 (FIGS. 17-19), which is coupled to the protective vest 101 as illustrated in FIGS. 1 and 19. In some embodiments, the mounting body 126 defines a middle portion 147 with a first end portion 148 and a second end portion 150 formed on opposite respective sides of the middle portion 147. In some embodiments, the mounting bar 128 which extends from the mounting body 126 may define a curved portion 191 formed between a first end 192 and a second end 193 that extend outwardly from the lower portion 141 of the mounting body 126. In some embodiments, the curved portion 191 of the mounting bar 128 may define a slightly upward curve towards the mounting body 126 as illustrated in FIGS. 12 and 13, although in other embodiments the curved portion 191 of the mounting bar 128 may curve slightly downward away from the mounting body 126. In some embodiments, the mounting bar 128 may be integral with the mounting body 126, while in other embodiments the mounting bar 128 may be securely attached to the lower portion 141 of the mounting body 126. As noted above, the mounting bar 128 is configured to be mechanically coupled to the locking mechanism 122 of the receiver component 114.

To engage the adapter component 116 to the receiver component 114, the rotatable biased arm 136 is rotated in an opposite direction B to the open position (FIG. 6) by overcoming the bias applied by the spring 184 to the rotatable biased member 136 such that the retention arm 138 becomes recessed within the passage 190 and does not block the channel 124. When the rotatable biased arm 136 is rotated to the open position, the mounting bar 128 of the adapter component 116 may be inserted within the channel 124 and the rotatable biased arm 136 rotated in the direction A to the normally-closed position (FIG. 7) that blocks the channel 124 by the retention arm 138 and secures the adapter component 116 to the receiver component 114.

As shown in FIG. 16-19, the first end portion 148 of the mounting body 126 may define a first slot 158 configured to receive the second end portion 142 of the first stay 112, while the second end portion 150 of the mounting body 126 may define a second slot 160 configured to receive the second end portion 144 of the second stay 113. A plurality of openings 167 are defined on opposite sides of each of the first and second end portions 148 and 150 of the mounting body 126 and communicate with respective first and second slots 158 and 160. The plurality of openings 167 are configured to receive a respective securing member 165 (FIG. 17) to secure the first and second stays 112 and 113 to respective first and second end portions 148 and 150 of the mounting body 126.

Figure 20:
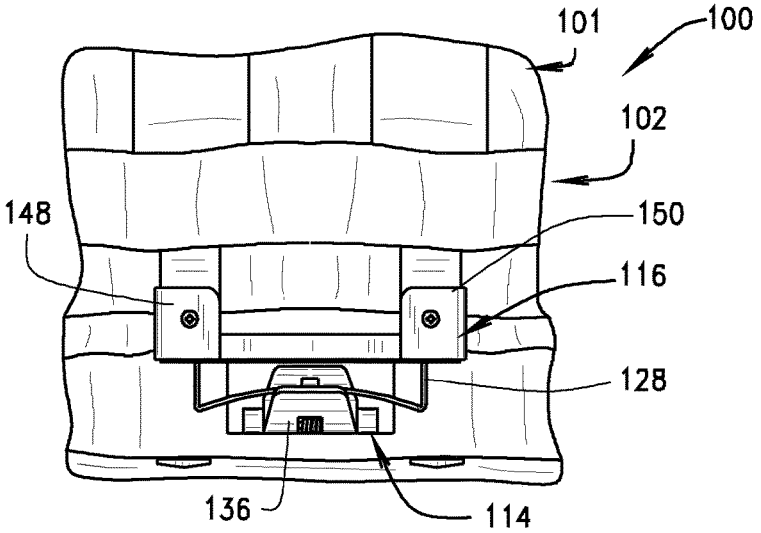
FIG. 20 is an enlarged front view of the adapter component coupled to the receiver component and the dynamic load carriage apparatus when mounting the protective vest to the base belt.
Figure 21:
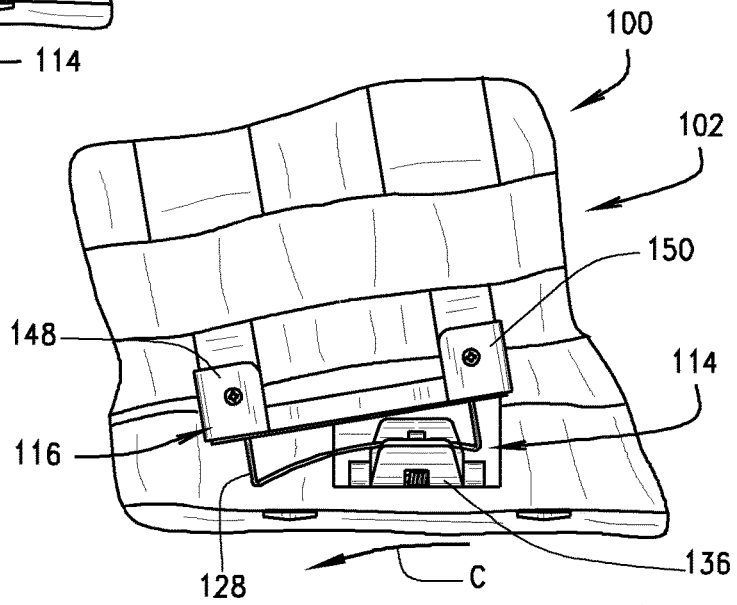
FIG. 21 is an enlarged front view showing the sliding action of the adapter component relative to the receiver component in one direction when a shift in load occurs.
Figure 22:
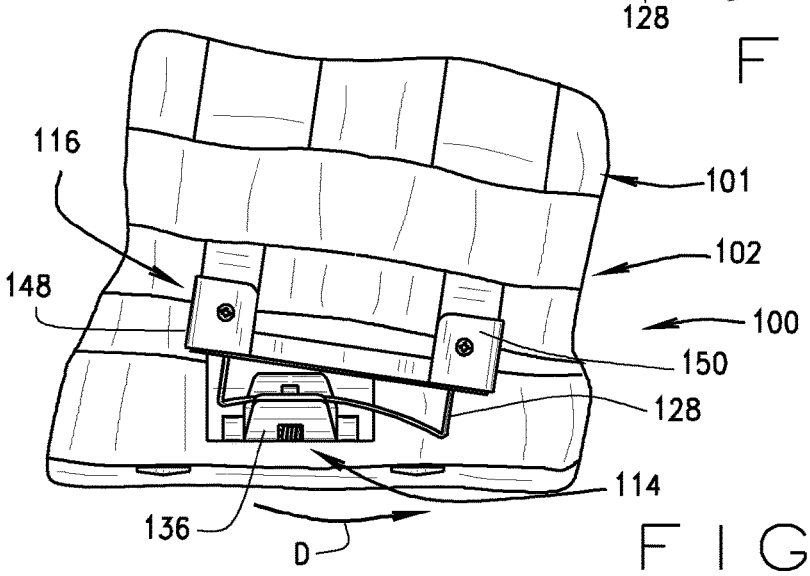
FIG. 22 is an enlarged front view showing the sliding action of the adapter component relative to the receiver component in an opposite direction when a shift in load occurs.

In some embodiments, the universal adapter system 100 may interact with the dynamic load carriage apparatus 102 as a means for compensating in any shift in load when the individual assumes a different body position. As shown in FIG. 20, the rotatable biased arm 136 may be in contact with the curved portion 191 of the mounting bar 128 between the first and second ends 192 and 193 when there is no shift in load, such as when the individual is stationary and/or in a substantially upright position. As illustrated in FIG. 21, movement of the individual in a particular direction and/or the individual assuming a particular body position that causes a shift in load may be compensated by the dynamic load carriage apparatus 102 through a sliding action of the mounting bar 128 in direction C along the channel 124 of the locking mechanism 122. As illustrated in FIG. 22, movement of the individual in an opposite direction or the individual assuming another body position that causes a shift in load that may also be compensated through a sliding action of the mounting bar 128 in an opposite direction D along the channel 124 of the locking mechanism 122. In this manner, any shift in load that occurs is compensated through sliding action of the mounting bar 128 along the channel 124 of the receiver component 114. In addition to a sliding action that compensates for any shift in load when the individual assumes a different body position, the mounting bar 128 may also move in a twisting action relative to channel 124. In some embodiments, the twisting and/or sliding actions of the mounting bar 128 may also result in the mounting bar 128 becoming disengaged from the channel 124 of the rotatable biased arm 136 of the receiver component 114. For example, a sliding action where either the first or second ends 192 and 193 of the mounting bar 128 contacts the channel 124 can cause the mounting bar 128 to disengage from the rotatable biased arm 136.

In one aspect, as noted above the universal adapter system 100 allows the individual to either engage or disengage the adapter component 116 from the receiver component 114 in a hand-free operation while wearing the base belt 104 and protective vest 101. In another aspect, the universal adapter system 100 allows the individual to either engage or disengage the adapter component 116 from the receiver component 114 in a one-handed operation while wearing the base belt 104 and protective vest 101.

In one aspect of the universal adapter system 100, the individual may either engage or disengage the adapter component 116 from the receiver component 114 in a hands-free operation while the individual is wearing the base belt 104 and the protective vest 101 is mounted to the base belt 104. In another aspect, the universal adapter system 100 allows the individual to engage or disengage the adapter component 116 from the receiver component 114 in a one-handed operation by the individual while the individual is wearing the base belt 104 and the protective vest 101 is mounted to the base belt 104.

In some embodiments, the universal adapter system 100 comprise modular components that are secured to respective load bearing packs, dynamic load carriage apparatuses, protective vests, and tactical belts and may be interchanged for other embodiments of the universal adapter systems 100. In some embodiments, the universal adapter system 100 comprises integral components that are permanently engaged to respective load bearing packs, dynamic load carriage apparatuses, protective vests, and tactical belts during manufacture.

It should be understood from the foregoing that, while particular embodiments have been illustrated and described, various modifications can be made thereto without departing from the spirit and scope of the invention as will be apparent to those skilled in the art. Such changes and modifications are within the scope and teachings of this invention as defined in the claims appended hereto.

What is claimed is:

1. A tactical system for wearing by an individual comprising:

a protective vest;

a base belt; a dynamic load carriage apparatus operatively coupled to the protective vest with a first stay and a second stay configured to distribute a load from the protective vest to the base belt;

a receiver component of a universal adapter system having a base portion coupled to the base belt;

a locking mechanism secured to the base portion, the locking mechanism comprising a retention arm and a rotatable biased arm defining a channel, the rotatable biased arm rotatable between an open position and a closed position, the retention arm providing access to the channel in the open position and blocking access to the channel in the closed position;

an adapter component coupled to the protective vest; and a mounting bar extending from the adapter component and receivable within the channel of the rotatable biased arm, the mounting bar displacing within the channel relative to the rotatable biased arm in response to movement of the individual causing a load shift of the dynamic load carriage apparatus, the displacement of the mounting bar compensating for the load shift through at least one of a sliding action or a twisting action.

2. The tactical system of claim 1, wherein the protective vest includes a first sleeve to encase the first stay and a second sleeve to incase the second stay.

3. The tactical system of claim 1, wherein the base belt comprising a belt body having a webbing portion.

4. The tactical system of claim 3, wherein the receiver component is operatively couple to the base belt with the webbing portion.

5. The tactical system of claim 1, wherein the dynamic load carriage apparatus disconnects the protective vest form the base belt in a hands-free operation.

6. The tactical system of claim 1, wherein the dynamic load carriage apparatus disconnects the protective vest form the base belt in a one-handed operation.

7. The tactical system of claim 1, wherein the rotatable biased arm comprises a first raised portion and a second raised portion that collectively define the channel, the first raised portion defining a passage in perpendicular relation to the channel, the retention arm extending through the passage when the rotatable biased arm is in the closed position.

8. The tactical system of claim 1, wherein the locking mechanism comprises a spring having a spring bias maintaining the rotatable biased arm in the closed position.

9. The tactical system of claim 1, wherein the rotatable biased arm comprises a rod member securing the rotatable biased arm to the base portion such that the rotatable biased arm rotates about a pivot point defined by the rod member between the open position and the closed position.

10. The tactical system of claim 1, wherein the first stay defines a first end portion coupled to the adapter component and a second end portion secured to the protective vest and the second stay defines a first end portion coupled to the adapter component and a second end portion secured to the protective vest.

* * * * *